US006756010B2

(12) United States Patent
Harada et al.

(10) Patent No.: US 6,756,010 B2
(45) Date of Patent: Jun. 29, 2004

(54) METHOD AND APPARATUS FOR PRODUCING COMPACT OF RARE EARTH ALLOY POWDER AND RARE EARTH MAGNET

(75) Inventors: Tsutomu Harada, Osaka (JP); Hitoshi Morimoto, Hyogo (JP); Atsuo Tanaka, Hyogo (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 213 days.

(21) Appl. No.: 10/166,250

(22) Filed: Jun. 11, 2002

(65) Prior Publication Data

US 2002/0153061 A1 Oct. 24, 2002

Related U.S. Application Data

(62) Division of application No. 09/691,266, filed on Oct. 19, 2000, now Pat. No. 6,432,158.

(30) Foreign Application Priority Data

Oct. 25, 1999 (JP) ..... 11-302679

(51) Int. Cl.[7] ..... B22F 3/00
(52) U.S. Cl. ..... 419/6; 419/66
(58) Field of Search ..... 419/6, 66

(56) References Cited

U.S. PATENT DOCUMENTS 3,690,805 A * 9/1972 Kopicko ..... 425/352
4,600,555 A * 7/1986 Shimizu ..... 419/5
4,770,723 A 9/1988 Sagawa et al.
5,340,532 A * 8/1994 Bergstrom ..... 419/38
5,383,978 A 1/1995 Yamamoto et al.
5,886,070 A 3/1999 Honkura et al.
5,913,255 A 6/1999 Kikuchi et al.
6,007,757 A 12/1999 Honkura et al.

FOREIGN PATENT DOCUMENTS

| | | |
|---|---|---|
| JP | 2-281721 | 11/1990 |
| JP | 4-352402 A | 12/1992 |
| JP | 5-077099 | 3/1993 |
| JP | 09-233776 A | 9/1997 |
| JP | 10-152702 A | 6/1998 |
| WO | WPO 99/07006 | 2/1999 |

OTHER PUBLICATIONS

Notice of Reasons for Rejection (Dated Mar. 11, 2003).

* cited by examiner

*Primary Examiner*—Ngoclan T. Mai
(74) *Attorney, Agent, or Firm*—Nixon Peabody LLP; Jeffrey L. Costellia

(57) ABSTRACT

A method for producing a compact of rare earth alloy powder of the present invention includes: a powder-filling step of filling rare earth allow powder in a cavity formed by inserting a lower punch into a through hall of a die of a powder compacting machine; and a compression step of pressing the rare earth alloy powder while applying a magnetic field, the steps being repeated a plurality of times. When the (n+1)th (n is an integer equal to or more than 1) stage compression step is to be carried out, the top surface of a compact produced in the n-th stage compression step is placed at a position above the bottom surface of a magnetic portion of a die.

16 Claims, 12 Drawing Sheets

FILLING

COMPRESSION

FILLING

COMPRESSION

FIRST STAGE
SECOND STAGE
10
10a
10b
12a
12b
14
16
24
26
30
40

METHOD AND APPARATUS FOR PRODUCING COMPACT OF RARE EARTH ALLOY POWDER AND RARE EARTH MAGNET

BACKGROUND OF THE INVENTION

The present invention relates to a method for producing a compact (i.e., green compact) of rare earth alloy powder, a rare earth magnet, and a powder compacting machine. More particularly, the present invention relates to a powder pressing method for a rare earth magnet that has a form requiring multi-stage filling and compacting of rare earth alloy powder.

When magnetic powder is filled in a cavity of a powder compacting machine (a press machine) and simply compressed, the magnetic moments of powder particles are only randomly oriented. If a magnetic field is formed in the cavity and magnetic powder filled in the cavity is compressed in the magnetic field, a compact with powder particles aligned in a desired direction can be produced. If the compact is made of rare earth alloy powder excellent in magnetic properties, a high-performance anisotropic magnet can be manufactured from the compact.

FIG. 1 illustrates a typical compacting machine used for the case of orienting magnetic powder particle in a radial direction. The machine in FIG. 1 includes a die 10 having a through hole, a magnetic core 12 having an outer circumference facing the inner wall of the through hole of the die 10, a cylindrical lower punch 14 inserted into the through hole of the die 10 from below, and a cylindrical upper punch 16 inserted into the through hole of the die 10 from above. The magnetic core 12 is composed of an upper core 12*a* and a lower core 12*b* that fit in core holes of the upper punch 16 and the lower punch 14, respectively. The upper core 12*a* and the lower core 12*b* are made of a ferromagnetic material, while the upper punch 16 and the lower punch 14 are made of a nonmagnetic material (e.g., core 12).

The die 10 shown in FIG. 1 has a layered structure composed of an upper portion made of a ferromagnetic material (magnetic portion 10*a*) and a lower portion made of a nonmagnetic material (nonmagnetic portion 10*b*). A cylindrical space is defined between the outer circumference of the core 12 and the inner wall of the magnetic portion 10*a* of the die 10. The cylindrical space can be blocked with the upper punch 16 and the lower punch 14 on the top and bottom sides thereof, respectively. The outer circumference of the core 12, the inner wall of the die 10, and top end face of the lower punch 14 form a "cavity" into which powder is filled. Magnetic powder 24 filled in the cavity is sandwiched by the upper punch 16 and the lower punch 14 and thus compacted by compression. In this case, the cavity is defined by the top end face of the lower punch 14, the outer circumference of the core 12, and the inner wall of the magnetic portion 10*a* of the die 10. A cylindrical sleeve 11 made of a nonmagnetic material may optionally be provided on the inner wall of the through hole of the die 10 to ensure that no step will be formed between the ferromagnetic portion and the nonmagnetic portion and that a compact will not be injured by such a step during removal from the die. In this case, the cavity is defined by the top end face of the lower punch 14, the outer circumference of the core 12, and the inner wall of the sleeve 11.

An upper coil 20 and a lower coil 22 are provided for forming a radial magnetic field inside the cavity. A magnetic field generated by the upper coil 20 and a magnetic field generated by the lower coil 22 repel each other in and around the center portion of the magnetic core 12, thereby forming a radial magnetic field that expands from the center portion of the core 12 radially toward the die 10. The arrows in FIG. 1 represent magnetic fluxes in the magnetic materials.

In order to improve the degree of alignment of magnetic powder in a compact to be produced, an intense radial magnetic field must be formed in the cavity. In order to increase the intensity of the radial magnetic field, it is desirable to increase electric power supplied to the coils 20 and 22, as well as optimizing the size and material of the core 12. However, increase in the electric power supplied to the coils will raise production cost and also cause a trouble of generating heat. Optimization of the size and material of the core is difficult because the core size is defined by the inner diameter of a magnet to be produced and improvement of the core material is limited.

In view of the above, when an axially elongated cylindrical magnet is to be manufactured, a multi-stage compacting process is employed where a powder filling step and a pressing step are repeated a plurality of times to ensure that an aligning magnetic field with a sufficient intensity is applied. In the multi-stage compacting process, when a long cylindrical compact is to be produced, a cycle of powder filling/compression in the magnetic field is repeated to sequentially produce axially divided portions of the compact. Accordingly, the cavity length per cycle is small and thus the intensity of the radial magnetic field formed in the cavity can be increased.

A conventional multi-stage compacting process will be described with reference to FIGS. 1, 2A and 2B.

First, as shown in FIG. 1, the magnetic powder 24 filled in the cavity is pressed in the presence of a magnetic field to produce a first-stage compact 26 (first-stage compression step). Thereafter, as show in FIG. 2A, magnetic powder 24 is filled in a cavity formed on the upper surface of the first-stage compact (denoted by 26) and pressed in the presence of a magnetic field (second-stage compression step). In the second-stage compression step, the cavity is defined by the top surface of the first-stage compact 26, the outer circumference of the core 12, and the inner wall of the magnetic portion 10*a* of the die 10. As show in FIG. 2B, by the second-stage compression step, a second-stage compact 28 is formed on the first-stage compact 26. The two compacts are integrated to form a compact 30.

By repeating the powder filling step and the compression step a plurality of times in the manner described above, an anisotropic ring magnet having a desired axial length can be manufactured beyond the limitation of the axial length L (see FIG. 1) of the magnetic portion 10*a* of the die 10. This method for manufacturing an anisotropic ring magnet by multi-stage compacting is disclosed in Japanese Laid-Open Publication No. 9-233776, for example.

The anisotropic magnet manufactured by the above conventional method has the following problem. Disorder in alignment arises at the boundary of the first-stage compact 26 and the second-stage compact 28, resulting in degradation in magnetization at the boundary.

FIG. 3 is a graph showing the surface magnetic flux density (Bg) at the outer circumference of a ring magnet (a cylindrical magnet) manufactured by the conventional multi-stage compacting method. The ring magnet manufactured and evaluated had an outer diameter of 16.4 mm, an inner diameter of 10.5 mm, and an axial length of 20 mm as measured after surface finishing. In the graph, the surface magnetic flux density (Bg) at the outer circumference of the magnet is shown by the solid line. The measurement was made using a gauss meter by scanning the surface of the magnet with a measuring probe. In the graph in FIG. 3, values in a region B correspond to values measured on the second-stage compact 28, while a values in a region C correspond to values measured on the first-stage compact 26.

FIG. 4 is a perspective view of the cylindrical magnet of FIG. 3, denoted by 32. The left-hand side of the magnet 32 (corresponding to the compact 30) in FIG. 4 corresponds to the upper portion of the compacting machine (upstream portion with respect to the pressing direction).

As is apparent from the graph in FIG. 3, a large drop in surface magnetic flux density (Bg) is observed at the boundary of the first-stage and second-stage compacts 26 and 28. Actually, the surface magnetic flux density (Bg) at the boundary is about 60% or less of the maximum value of the surface magnetic flux density (Bg) at the other portions.

The inventors of the present invention considered that the above local drop in magnetic flux density (Bg) was generated for the following reason. When the second-stage compression in the magnetic field is to be performed in the state where the first-stage compact 26 rests on the top end face of the lower punch 14 as shown in FIGS. 2A and 2B, magnetic fluxes leak to the first-stage compact 26 that is magnetic, resulting in generating distortion in the distribution of the radial magnetic field. This occurs because the magnetic field generated from the lower core 12*b* concentrates on and around the top surface of the first-stage compact 26 since magnetic fluxes pass through the first-stage compact 26 more easily compared with the rare earth alloy magnetic powder 24 filled for the second stage compression. In this way, magnetic fluxes shortcut to the magnetic potion 10*a* from the lower core 12*b* passing through the top portion of the first-stage compact 26 due to its high permeability, and as a result, distortion in the distribution of a radial magnetic field is generated significantly at and around the boundary of the first-stage and second-stage compacts 26 and 28. This means that the radial components of the aligning magnetic field decreases while the axial components thereof increases. If the number of axial components of the aligning magnetic field increases, the alignment of the magnetic powder 24 is disordered, resulting in lowering the degree of alignment.

If the distribution of the radial magnetic field formed in the second-stage compression step is disordered, the orientation of the powder is disordered not only in the second-stage compact 28 but also in the first-stage compact 26 even if disorder was small in the distribution of the radial magnetic field formed in the first-stage compression step. This is because particles are reoriented in an intense magnetic field such as that of 0.4 MA/m or more even after the magnetic powder 24 was already subjected to compression. If the magnetic powder 24 includes a lubricant, powder particles are likely to rotate more easily. In this case, therefore, the orientation or alignment of the first-stage compact 26 is further disordered. As the magnetic field applied in the second-stage compression step is greater, the degree of alignment of the first-stage compact 26 is more lowered.

The lowering in the degree of alignment is considered more likely when a sintered magnet is manufactured than when a bonded magnet is manufactured. This is because, when magnetic powder is compacted for sintering, the compression density of the powder is made comparatively small. The resultant first-stage compact 26 is more susceptible to a disordered magnetic field due to this reduced compaction.

The conventional method has another problem as follows. When a compact produced by the multi-stage compacting method is sintered, the resultant sintered body is poor in size precision. The reason is that rare earth alloy powder used for manufacturing a rare earth sintered magnet is markedly poor in flowability if granulation (machining of powder) is not performed. It is difficult to fill such powder in the cavity at a uniform density. In addition, it is difficult to feed a dispensed amount of powder to a cavity if the cavity is of a cylindrical shape. Therefore, a feeder box containing powder in an amount far exceeding the amount to be filled is moved to the position above the cavity, where the powder is allowed to fall freely and the powder filled in the cavity is wiped off with a bottom edge of the feeder box. This causes variation in filled amount of the powder. In the conventional pressing, the operations of the die and punches are controlled on the presumption that the filling density of powder in the cavity is uniform. The positions of the die and punches during compression invariably follow predetermined position settings. Therefore, if a variation exists in the filling density of powder, the density of the resultant compact varies, and thus the shrinkage rate of the compact during sintering varies. As a result, the size of the sintered body varies both in the compacting direction (height direction) and the thickness direction.

SUMMARY OF THE INVENTION

A primary object of the present invention is providing a method for producing a compact of rare earth alloy powder capable of producing a high-quality compact where local drop in the degree of alignment is suppressed even in the multi-stage filling and compacting process.

Another object of the present invention is providing a permanent magnet having an improved magnet properties obtained from a radially aligned compact produced by the above compacting method.

The method for producing a compact of rare earth alloy powder of the present invention uses a compacting machine including: a die including a nonmagnetic portion and a magnetic portion placed on the nonmagnetic portion, the die having a through hole; a magnetic core having an outer circumference facing an inner wall of the through hole; a lower punch for being inserted from below into a space formed between the inner wall of the through hole and the outer circumference of the magnetic core; and an upper punch for being inserted from above into the space formed between the inner wall of the through hole and the outer circumference of the magnetic core. The method comprising: a powder-filling step comprising filling rare earth allow powder in a cavity formed by inserting the lower punch into the through hole; and a compression step comprising pressing the rare earth alloy powder while applying a magnetic field to the rare earth alloy powder, the powder-filling and compression steps being repeated a plurality of times. When an (n+1)th stage compression step is to be carried out, where n is an integer equal to or greater than 1, a top surface of a compact produced in an n-th stage compression step is placed at a position above a bottom surface of the magnetic portion of the die.

Alternatively, the method for producing a compact of rare earth alloy powder of the present invention includes: a powder filling step of filling rare earth alloy powder in a cavity formed in a space between a first magnetic member and a second magnetic member; and a compression step of pressing the rare earth alloy powder while applying a magnetic field, the steps being repeated a plurality of times.

When an (n+1)th (n is an integer equal to or more than 1) stage compression step is to be carried out, at least part of a compact produced in an n-th stage compression step is placed in the space between the first magnetic member and the second magnetic member.

The intensity of the magnetic field in the cavity is preferably 0.4 MA/m or more.

A lubricant may be added to the rare earth alloy powder.

Preferably, the amount of the rare earth alloy powder filled in the cavity is larger in an n-th stage powder filling step than in an (n+1)th stage powder-filling step.

Preferably, in the (n+1)th stage compression step, the level difference between the top surface of the compact produced in the n-th stage compression step and the bottom surface of the magnetic portion of the die is 3 mm or more.

Preferably, in the (n+1)th stage compression step, the height of the part of the compact produced in the n-th stage compression step placed in the space is 3 mm or more.

In a preferred embodiment, the rare earth alloy powder is made of a R-T-(M)-B alloy (where R denotes a rare earth element containing at least one kind of element selected from Y, La, Ce, Pr, Nd, Sm, Gd, Th, Dy, Ho, Er, Tm, and Lu; T denotes Fe or a mixture of Fe and Co; M denotes an additive element; and B denotes boron).

Preferably, the compact is of a cylindrical shape, and the magnetic field is a radial magnetic field.

The density of the compact produced in the n-th stage compression step is preferably 3.5 g/cm$^3$ or more.

In a preferred embodiment, the compression step of pressing rare earth alloy powder while applying a magnetic field includes a step of measuring the pressure applied to the rare earth alloy powder filled in the cavity.

Preferably, the density of the compact produced in the compression step is adjusted by controlling the pressure applied to the rare earth alloy powder.

The method for manufacturing a rare earth magnet of the present invention includes sintering, to obtain a permanent magnet, a compact produced by any method for producing a compact of rare earth alloy powder described above.

The rare earth magnet of the present invention is manufactured by repeating a plurality of times a powder filling step of filling rare earth allow powder in a cavity and a compression step of pressing the rare earth alloy powder while applying a magnetic field. The surface magnetic flux density at a boundary of an upper compact produced in an (n+1)th (n is an integer equal to or more than 1) stage compression step and a lower compact produced in an n-th stage compression step is 65% or more of the maximum value of the surface magnetic flux density at the other portions.

The powder compacting machine of the present invention includes: a die including a nonmagnetic portion and a magnetic portion placed on the nonmagnetic portion, the die having a through hole extending through the nonmagnetic portion and the magnetic portion; a magnetic core having an outer circumference facing an inner wall of the through hole of the die; a lower punch for being inserted from below into a space formed between the inner wall of the through hole of the die and the outer circumference of the magnetic core; an upper punch for being inserted from above into the space formed between the inner wall of the through hole of the die and the outer circumference of the magnetic core; a powder feed device for filling magnetic powder in a cavity formed by inserting the lower punch into the through hole of the die; a magnetic field generator for applying a magnetic field to the magnetic powder filled in the cavity; a first controller for controlling relative positions of the die and the lower punch; and a second controller for controlling relative positions of the upper punch and the lower punch. The powder compacting machine operating to repeat a powder-filling step comprising filling magnetic powder in the cavity and a compression step comprising pressing the magnetic powder while applying the magnetic field to the magnetic powder. The first controller controls the relative positions of the die and the lower punch so that when an (n+1)th stage compression step is to be carried out, where n is an integer equal to or greater than 1, a top surface of a compact produced in an n-th stage compression step is placed at a position above a bottom surface of the magnetic portion of the die.

In a preferred embodiment, the powder compacting machine further includes a pressure sensor for measuring a pressure applied to the magnetic powder.

Preferably, the pressure sensor includes a strain gage adapted for detecting strain on the upper punch or the lower punch.

Preferably, the second controller controls the relative positions of the upper punch and the lower punch according to the pressure detected by the pressure sensor.

Alternatively, the method for producing a compact of rare earth alloy powder of the present invention includes: a first cavity formation step of forming a first cavity defined by a die and a lower punch; a first powder-filling step of filling rare earth alloy powder in the first cavity; a first compression step of compressing the powder filled in the first cavity until a pressure applied to the powder in the first cavity reaches a predetermined value; a second cavity formation step of forming a second cavity on the compressed powder by relative movement of the die and the lower punch after the first compression step; a second powder filling step of filling rare earth alloy powder in the second cavity; and a second compression step of compressing the powder filled in the second cavity until a pressure applied to the powder in the second cavity reaches a predetermined value.

In a preferred embodiment, the method further includes a storing step of storing the position of a top surface of the compact produced in the first compression step, and the second cavity formation step includes forming the second cavity by the relative movement of the die and the lower punch based on the position of the top surface of the compact.

Preferably, the first cavity and the second cavity are of a cylindrical shape.

DETAILED DESCRIPTION OF THE INVENTION

Hereinafter, a preferred embodiment of the present invention will be described with reference to the accompanying drawings.

Figure 1:
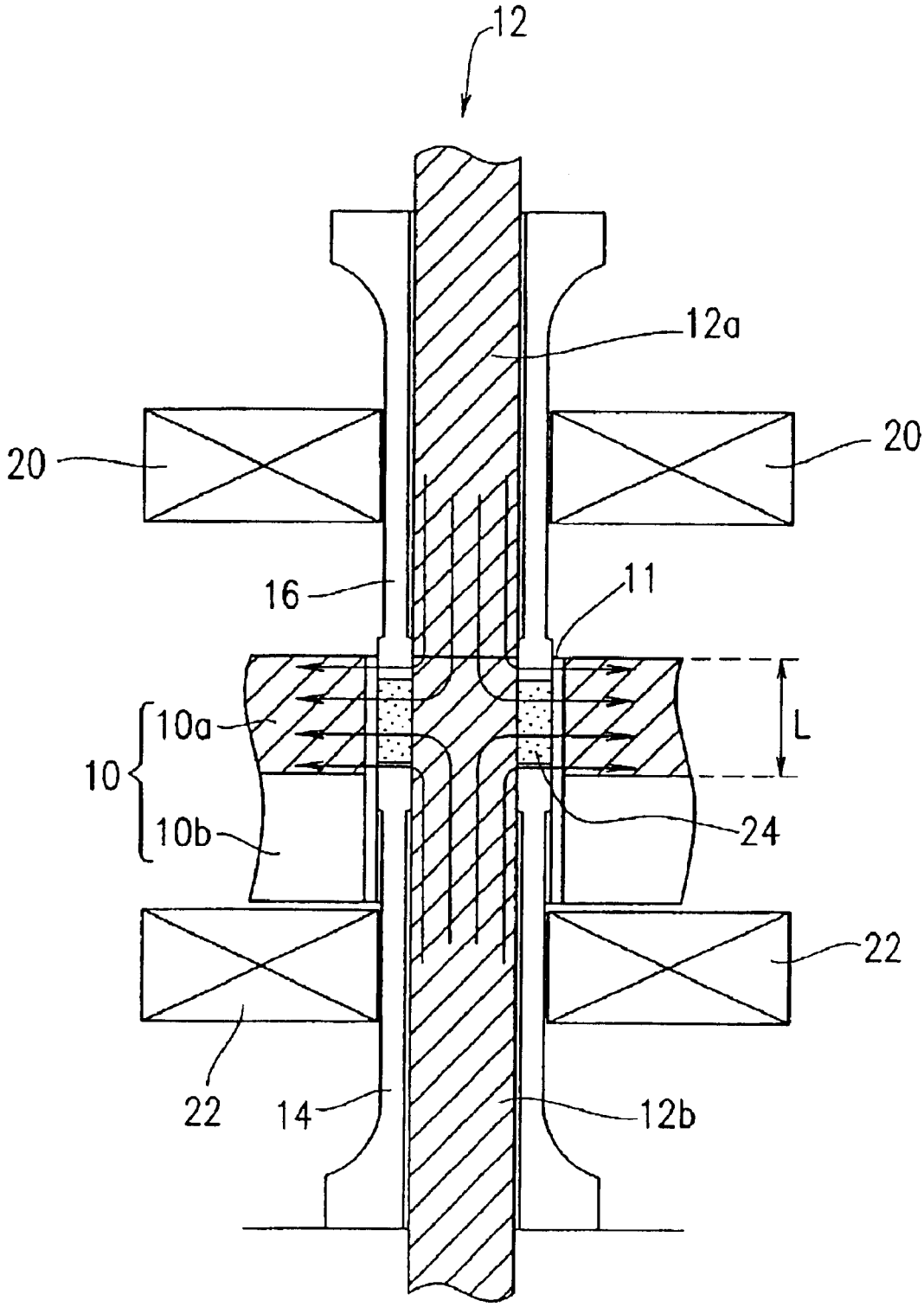
FIG. 1 is a cross-sectional view of a typical powder compacting machine (press machine) where magnetic powder is radially oriented.
Figure 2A:
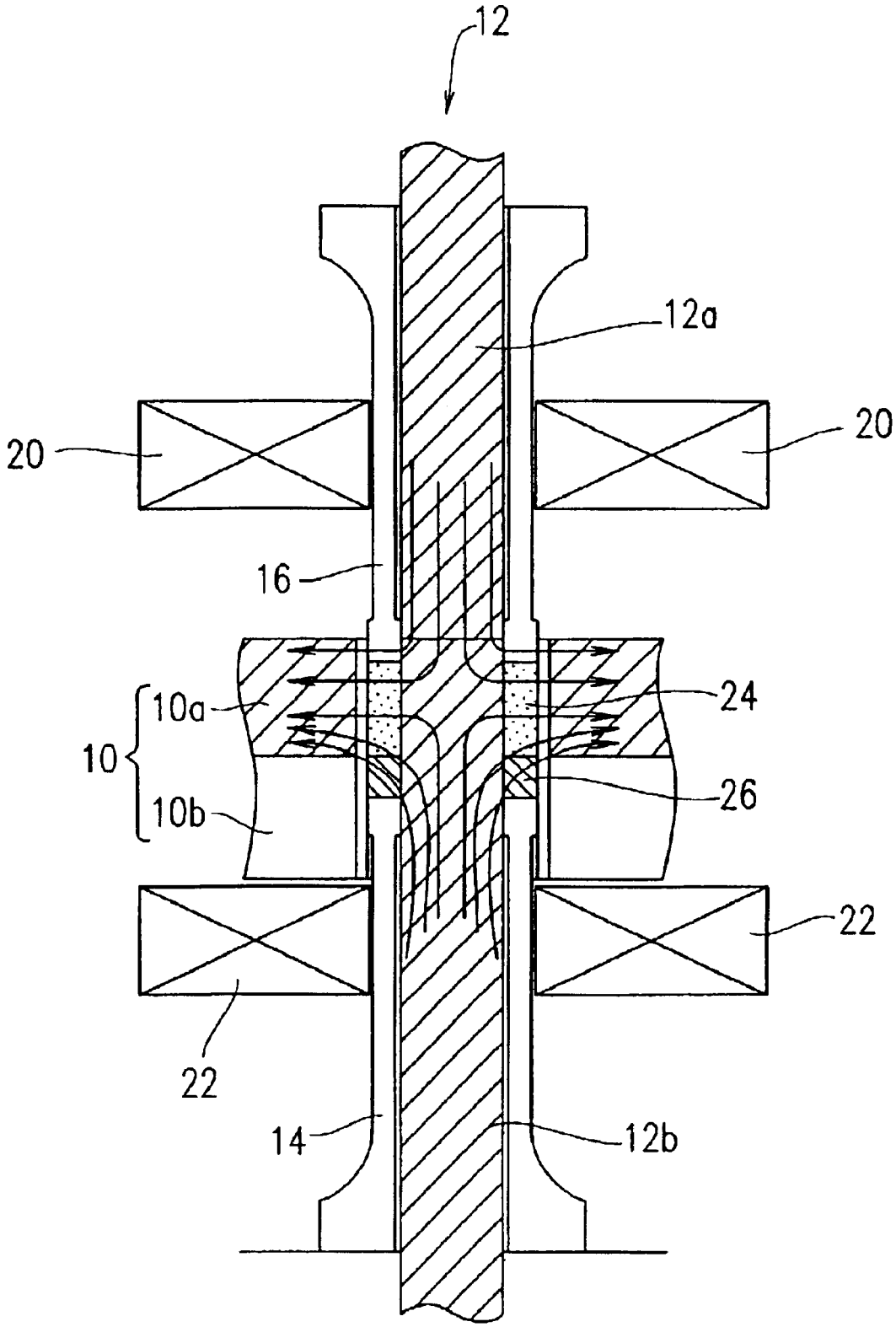
FIGS. 2A and 2B is a cross-sectional view schematically illustrating a magnetic field in the second-stage compression step observed when magnetic powder is to be radially oriented by multi-stage compacting.
Figure 2B:
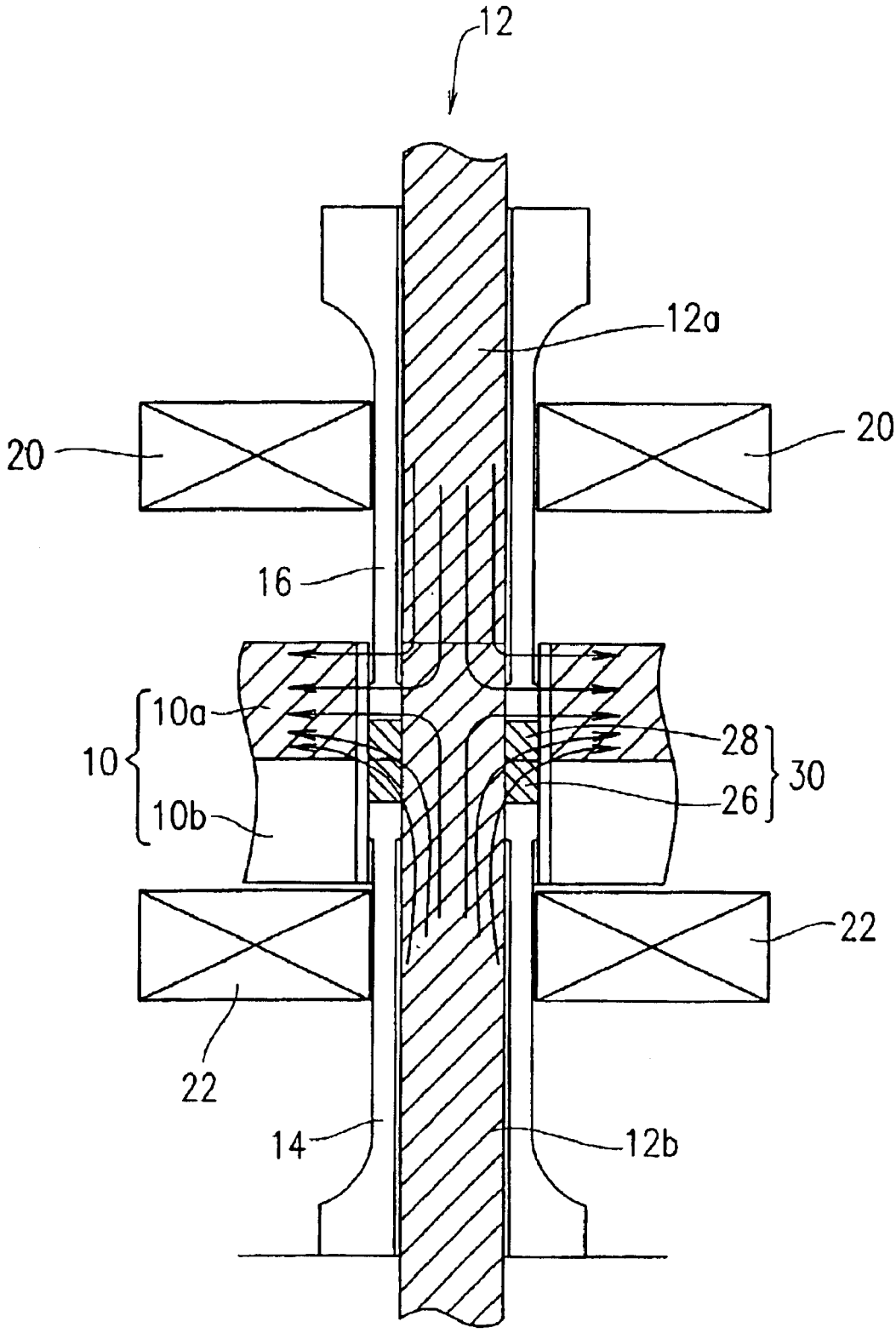

First, referring to FIG. 5, the entire construction of a powder compacting machine according to the present invention will be described. A powder compacting machine 5 includes a die 10 having a through hole, a cylindrical lower punch 14 inserted into the through hole of the die 10 from below, and a cylindrical upper punch 16 inserted into the through hole of the die 10 from above. Magnetic cores 12*a* and 12*b* for forming a radial magnetic field fit in core holes of the upper punch 16 and the lower punch 14, respectively. The die 10 has a layered structure composed of an upper portion made of a ferromagnetic material (magnetic portion) and a lower portion made of a nonmagnetic material (nonmagnetic portion). As used herein, the term "nonmagnetic material" is defined as including the material having a saturation magnetization of 0.6 T or less. The construction of the press section described above is the same as that of the machine shown in FIG. 1. The same components as those in FIG. 1 are denoted by the same reference numerals.

The die 10 is secured to a die set 50. The die set 50 is coupled to a lower plate 56 via guide bars 54 that extend through a base plate 52. The lower plate 56 is coupled to a lower hydraulic cylinder 58*b* via a cylinder rod 58*a*. With this construction, the die 10 can be moved upward and downward by means of the lower hydraulic cylinder 58*b*. The position of the die 10 is detected with a position sensor 59 that can be appropriately constructed using, for example, a linear scale and the like. By controlling the operation of the lower hydraulic cylinder 58*b* based on a measured value, the die 10 can be set at a desired position.

The lower punch 14 is secured to the base plate 52 at the position thereof inserted in the through hole of the die 10 from below. Since the powder compacting machine 5 allows the die 10 having the through hole to move upward and downward as described above (a floating die style), it is not necessary for the lower punch 14 to move upward and downward.

The top end of the upper punch 16 is attached to an upper plate 60. The upper plate 60 is coupled to an upper hydraulic cylinder 62*b* via a cylinder rod 62*a*. Guide bars 64 secured to the die set 50 extend through the upper plate 60 at opposite positions near the periphery thereof. The upper plate 60 and the upper punch 16 are movable upward and downward under the guidance of the guide bars 64 by means of the upper hydraulic cylinder 62*b*. The position of the upper punch 16 is detected with a position sensor 66 that can be appropriately constructed using a linear scale and the like. By controlling the operation of the upper hydraulic cylinder 62*b* based on a measured value, the upper punch 16 can be set at a desired position.

Upper and lower coils 20 and 22 are disposed on the upper and lower sides of the cavity, respectively, for applying a magnetic field to powder filled in the cavity. The upper coil 20 is disposed on the bottom surface of the upper plate 60, for example. The lower coil 22 is disposed on the bottom surface of the die set 50, for example. By use of repelling magnetic fields generated by the upper and lower coils 20 and 22, it is possible to apply to the powder in the cavity a radial magnetic field expanding from the center portion of the core 12 radially toward the die 10.

In this embodiment, the upper hydraulic cylinder 62*b* is provided with a pressure sensor A for measuring the hydraulic pressure. By use of this pressure sensor A, for example, it is possible to measure the pressure applied to the magnetic powder filled in the cavity. This technique is described in Japanese Laid-Open Publication No. 10-152702.

By use of the pressure sensor A, the compacting density of a compact is made more uniform during pressing compared with the case of using only the position sensor 66 for detecting the vertical position of the upper punch 16. In particular, when a ring magnet is to be manufactured as in this embodiment, the cavity has such a shape that makes it difficult for powder to be uniformly filled therein. Therefore, the amount of powder fed to the cavity tends to vary every filling step. Uniform filling is also difficult for R-T-B powder (where R denotes a rare earth element including Y, T denotes Fe or a mixture of Fe and Co, and B denotes boron), which is suitably used for this embodiment, since this includes many angular particles. In particular, alloy powder formed by a quenching method (cooling rate: $10^2$–$10^{4}$° C./sec) such as a strip casting method as described in U.S. Pat. No. 5,383,978 is narrow in particle distribution range, and therefore flowability is further reduced. This makes it difficult to perform uniform filling.

With the variation in the amount of powder filled in the cavity as described above, the compacting density will vary every compact produced if the upper punch 16 is invariably set at a predetermined position (relative to the lower punch 14) during powder pressing. On the other hand, by using the pressure sensor A as in this embodiment, the pressure applied to the powder (or compact) in the cavity is measured, and based on the measured pressure the position of the upper punch relative to the lower punch can be changed. This allows for invariable application of a predetermined pressure to the compact. In this way, it is possible to control the density of the compact so as to be substantially constant.

The use of the pressure sensor A is advantageous in the production of a compact by the multi-stage compacting process as in this embodiment. That is, a precise and desired compacting density can be obtained in each of the plurality of compression steps repeated for producing a compact.

For example, in an early compression step, a compact with a comparatively low density (soft compact) may be produced, and in the final compression step, a higher pressure may be applied to pack the entire compact. In this way, a compact with an entirely uniform density can be produced. The thus-produced compact is prevented from being shrunk at locally different shrinkage rates during sintering. As a result, a sintered magnet having a desired shape and desired magnetic properties is obtained.

The use of the pressure sensor A is also advantageous in that pressing operation can be controlled so that a sufficient pressure exceeding a predetermined level is applied to the powder in the cavity. By this control, a compact having a density exceeding a predetermined level can be produced in each compression step. This prevents the trouble that the compact produced at the preceding stage is re-oriented by a magnetic field formed in the compression step at the current stage.

The pressure applied to the magnetic powder (or compact) in the cavity may otherwise be measured with strain gages (not shown) attached to the upper punch 16, as will be described later. By use of strain gages, the pressure applied to the magnetic powder can be measured more precisely compared with the case of measuring the hydraulic pressure of the upper hydraulic cylinder 62*b*. In this case, therefore, a ring compact having a substantially uniform density can be produced without fail.

A feeder box 40 storing rare earth alloy powder 24 is disposed on the die set 50. The feeder box 40 is coupled to a hydraulic cylinder 42 via a cylinder rod so as to be movable forward and backward with respect to the through hole of the die 10.

The upper and lower punches 16 and 14 are made of a WC—Ni hard metal, for example, having a Rockwell hardness $H_RA$ in the range of 70 to 93 and a composition of 1.6 wt % of Mo, 20 wt % of Ni, and WC as the remainder. A hard metal includes an alloy formed by sintering/combining powder of a carbide containing at least one of the nine elements belonging to Groups IVa, Va, and Via of the periodic table using a metal such as Fe, Co, Ni, Mo, and Sn or an alloy thereof. As a hard metal, a WC—TaC—Co, WC—TiC—Co, or WC'TiC—TaC—Co alloy may also be used.

The upper and lower punches 16 and 14 may otherwise be made of an alloy steel. Examples of the alloy steel include high-speed steel mainly containing Fe—C, high manganese steel, and die steel. An alloy steel having a predetermined hardness is used as the upper and lower punches 16 and 14.

Thus, the upper and lower punches 16 and 14, which are made of a hard metal or an alloy steel having $H_RA$ in the range of 70 to 93, are provided with desired tenacity and elasticity. With these properties, the upper and lower punches 16 and 14 are resistant to breakage even when they are machined into a sharp configuration.

The method for compacting rare earth alloy powder (or method for producing a compact) of the embodiment of the present invention will be described with reference to FIGS. 6A through 6F. In this embodiment, the case of performing two cycles of powder filling/compression is described for convenience. It should be noted that the present invention is also applicable to the cases of performing three or more cycles of powder filling/compression.

Figures 6A, 6B, 6C, 6D, 6E, 6F:
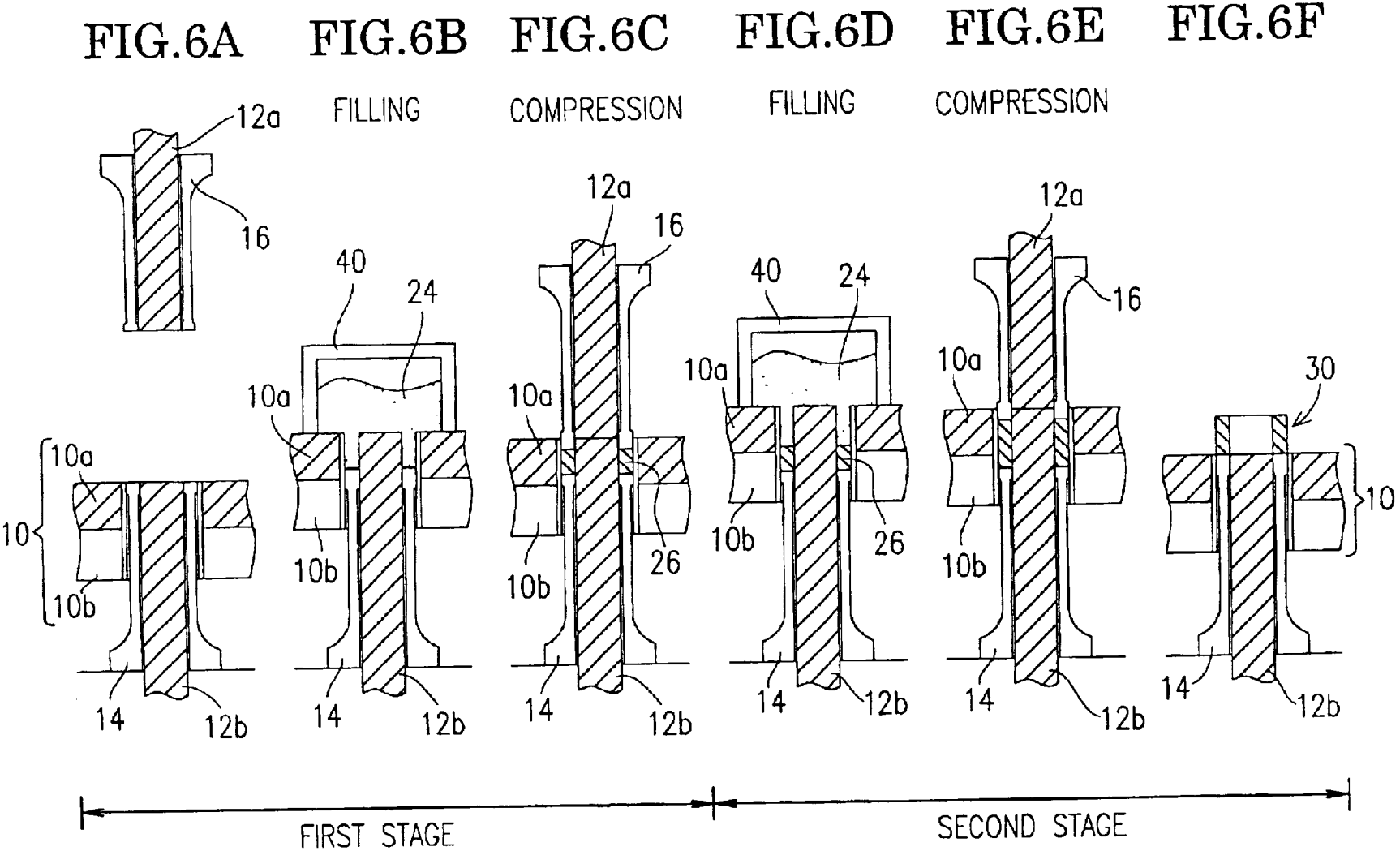
FIGS. 6A through 6F are cross-sectional views illustrating the steps of a method for compacting rare earth alloy powder in the embodiment of the present invention.

FIG. 6A illustrates the state where a compact produced in the preceding compression step has just been removed from the compacting machine. The upper punch 16 together with the upper core 12*a* are lifted apart from the die 10 while the top end face of the lower punch 14 is kept flush with the top surface of the die 10.

Referring to FIG. 6B, the die 10 and the lower core 12*b* are lifted. This lowers the relative position of the lower punch 14 with respect to the die 10 and the lower core 12*b*, and thus a cylindrical space (cavity) is formed in the through hole of the die 10. The cavity is open upward while being defined by the top end face of the lower punch 14 at the bottom, thereby forming a ring-shaped concave portion to be filled with rare earth alloy magnetic powder. Thereafter, the feeder box 40 for feeding rare earth alloy powder is slid to the position right above the cavity. The powder 24 stored in the feeder box 40 is fed to the cavity (first-stage powder-filling step). In the first-stage powder-filling step, the position of the bottom of the cavity, that is, the position of the top end face of the lower punch 14 is set equal to or higher than the position of the bottom surface of the magnetic portion 10*a* of the die 10. Hereinafter, in consideration of the case of performing three or more stages of powder filling, the space (cavity) to be filled with powder in the n-th stage (n is an integer equal to or more than 1) powder-filling step may sometimes be called the "n-th cavity".

Referring to FIG. 6C, after the feeder box 40 has retreated from the position above the cavity, the upper punch 16 together with the upper core 12*a* are lowered so that the bottom end face of the upper core 12*a* abuts against the top end face of the lower core 12*b*. The upper punch 16 is then inserted into the through hole of the die 10 and further lowered. Once the bottom end face of the upper punch 16 closes the cavity, magnetic fields repelling each other are generated in the core 12 to form a radial magnetic field in the cavity. In this embodiment, the intensity of the magnetic field in the cavity is set at 0.4 MA/m or more to secure sufficient magnetic properties. The powder filled in the cavity is compressed between the upper punch 16 and the lower punch 14 in the presence of the radial magnetic field (first-stage compression step). In this way, a radially-oriented first-stage compact 26 is produced. The magnetic field formed in the step of FIG. 6C is the same as that illustrated in FIG. 1. After the completion of the first-stage compression step, a magnetic field oriented reverse to the previously applied aligning magnetic field is applied to demagnetize the first-stage compact 26 by using the coils 20 and 22.

The density of the first-stage compact is preferably 3.5 g/cm$^3$ or more. More preferably, the density of the first-stage compact is 3.9–4.5 g/cm$^3$. If the density of the compact is less than this value due to insufficient compression, the first-stage compact 26 is more susceptible to reorientation.

In the first-stage compression step, the following control scheme may be adopted. That is, the pressure applied to the filled powder is detected and, once the pressure reaches a predetermined value, the compression is halted, and the process proceeds to the next step. The pressure sensor A shown in FIG. 5 may be used for this pressure detection. By adopting this control scheme, it is possible to produce compacts having a compacting density of 3.5 g/cm$^3$ or more invariably even when the amount of powder filled in the cavity varies. This prevents the already-produced first-stage compact from being re-oriented by the application of a magnetic field during production of the second-stage compact.

The above pressure detection may otherwise be performed using strain gages (strain sensors) associated with the upper punch. For example, the strain gages FCA-3-11-1L manufactured by Tokyo Sokki Kenkyujo Co., Ltd. may be used in this embodiment. As the number of strain gages is increased, a more precise pressure value is obtained. In this embodiment, a 4-gage method is adopted and four strain gages are attached to the periphery (the side) of the punch. The strain gages may be attached to the periphery of the upper punch 16 and/or the periphery of the lower punch 14.

The above strain gages can measure the magnitude of the strain at the top end of the upper punch 16 during the pressing. Accordingly, the pressure applied to the compact can be detected in real time with high precision.

Hereinafter, an example of a method for producing a compact using strain gages as described above will be described. In the state where the cavity is filled with powder, the upper punch 16 is lowered with respect to the lower punch 14, thereby gradually increasing the pressure applied to the powder. During this compression, the pressure applied to the powder is observed precisely in real time by the strain gages attached to the periphery of the upper punch 16. During this pressing process, the die 10 may also be lowered at a lower speed together with the lowering of the upper punch 16. This provides substantially the same pressure effect for the powder in the cavity as that obtained when the lower punch 14 is lifted while the upper punch 16 is lowered. This is effective in reducing variation in the density of the compact.

Subsequently, once the strain gages detect that the pressure applied to the powder (or compact) reaches a predetermined level, the lowering of the upper punch 16 is halted, thus to complete the compact. In this way, by producing a compact while measuring the pressure to the compact with the strain gages, the compacting density of the compact can be equal to or more than a predetermined level (e.g., 3.5 g/cm$^3$).

Referring to FIGS. 6C and 6D, while the upper and lower punches 16 and 14 keep pressing the compact at a predetermined pressure, the die 10 is lifted from the state shown in FIG. 6C, and further the cores 12*a* and 12*b* are lifted while keeping the abutting state therebetween. By this procedure, the compact is prevented from breaking due to friction generated during the lifting of the die 10 and the cores 12*a* and 12*b*. Thereafter, the upper punch 16 is lifted, forming another cavity (second cavity) on the top surface of the compact. The bottom of the second cavity is defined, now no longer by the lower punch 14, but by the top surface of the first-stage compact 26.

In the conventional multi-stage compacting method, the top surface of the first-stage compact 26 is flush with the bottom surface of the magnetic portion 10*a* of the die 10. According to the present invention, the positional relationship between the lower punch 14 and the die 10 is controlled so that the top surface of the first-stage compact 26 is located at a position above the bottom surface of the magnetic portion 10*a* of the die 10. The feeder box 40 is then moved to the position above the cavity so that the rare earth alloy powder is filled in the second cavity (second-stage powder filling step).

Referring to FIG. 6E, after the feeder box 40 has retreated from the position above the cavity, the upper punch 16 together with the upper core 12*a* are lowered so that the bottom end face of the upper core 12*a* abuts against the top end face of the lower core 12*b*. The upper punch 16 is then inserted into the through hole of the die 10 and further lowered. Once the bottom end face of the upper punch 16 closes the cavity, repelling magnetic fields are generated in the core 12 to form a radial magnetic field in the second cavity. The powder filled in the second cavity is compressed in the presence of the radial magnetic field (second-stage compression step). In this way, a second-stage compact 28 is formed on the first-stage compact 26. The two compacts are integrated to form a single compact 30. In this embodiment, the axial length of the first-stage compact 26 is about 13.5 mm, and the axial length of the second-stage compact 28 is about 10.5 mm.

Figure 7:
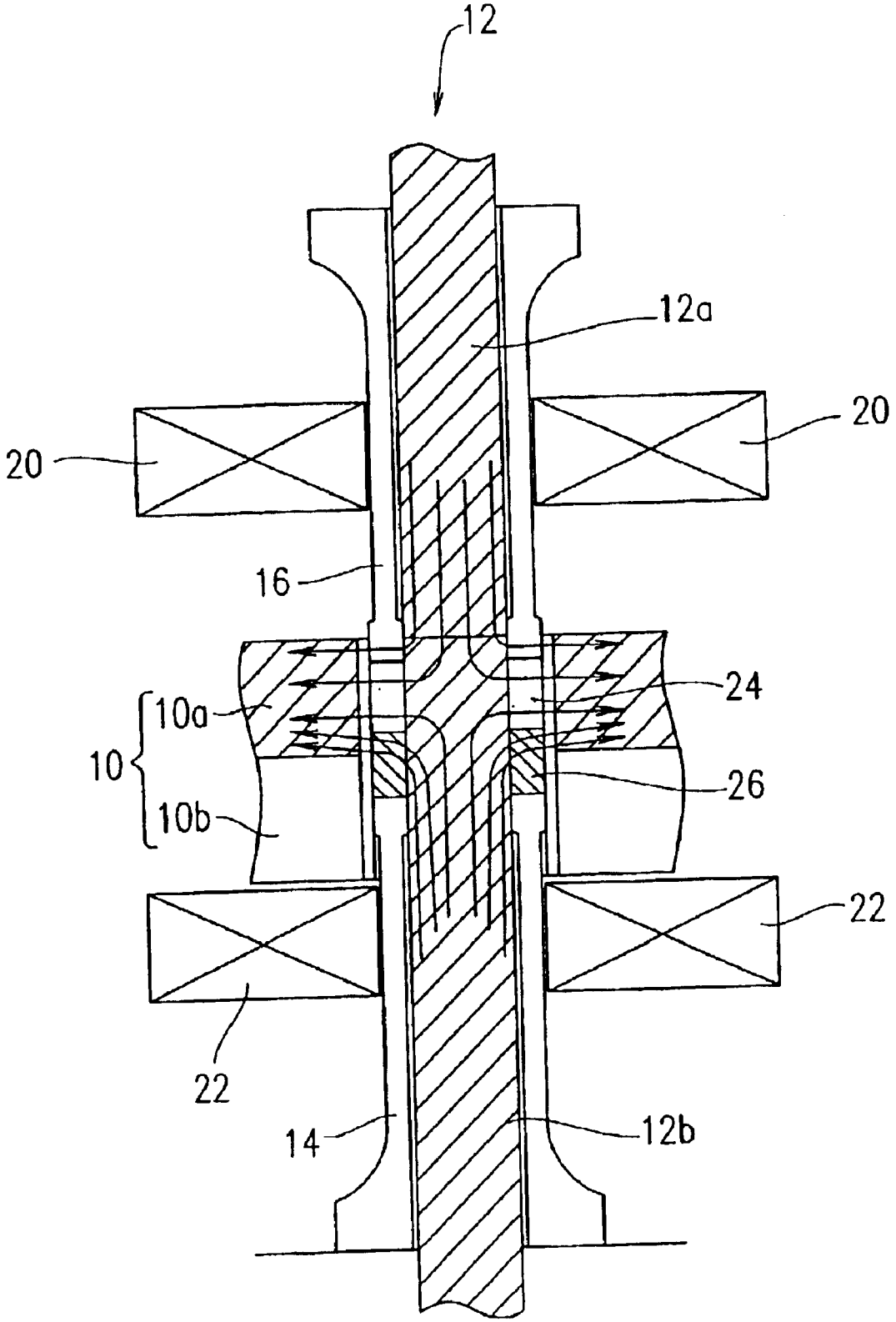
FIG. 7 is a cross-sectional view schematically illustrating a magnetic field formed in the step shown in FIG. 6E.

FIG. 7 is a cross-sectional view illustrating the magnetic field formed in the step shown in FIG. 6E. In the compacting of the filled powder in the second-stage compression step, the second cavity is located above the position of the bottom surface of the magnetic portion 10*a* of the die 10. In other words, the position of the first-stage compact 26 relative to the magnetic portion 10*a* is shifted upwardly from the conventional position. This advantageously reduces the axial components of the magnetic field (or magnetic fluxes) in the region where magnetic fluxes generated in the lower core 12*b* expands radially toward the magnetic portion 10*a* of the die 10. The resultant magnetic has the state close to the radial magnetic field shown in FIG. 1.

In this embodiment, the top surface of the first-stage compact 26 is located at a position higher by 3 mm or more than the bottom surface of the magnetic portion 10*a* of the die 10. The value of 3 mm exceeds 10% of the axial length (L=about 24 mm) of the magnetic portion 10*a* of the die 10 used in this embodiment. In addition, the value of 3 mm exceeds 20% of the axial length of the first-stage compact 26 produced in this embodiment, which is about 13.5 mm as described above.

After the completion of the second-stage compression step, a magnetic field oriented reverse to the previously applied aligning magnetic field is applied to demagnetize the compact 30 by using the coils 20 and 22. Thereafter, referring to FIG. 6F, the upper punch 16 together with the upper core 12*a* are lifted while the die 10 is lowered, to remove the compact 30.

The thus-produced compact 30 is sintered, surface-treated and magnetized, to obtain a radially-oriented anisotropic ring magnet.

During the removal of the compact 30, the operations of the upper punch 16 and the die 10 may be controlled based on the pressure to the compact (compact pressure) measured with the strain gages described above. An example of removal of the compact 30 will be described with reference to FIG. 8.

Figure 8:
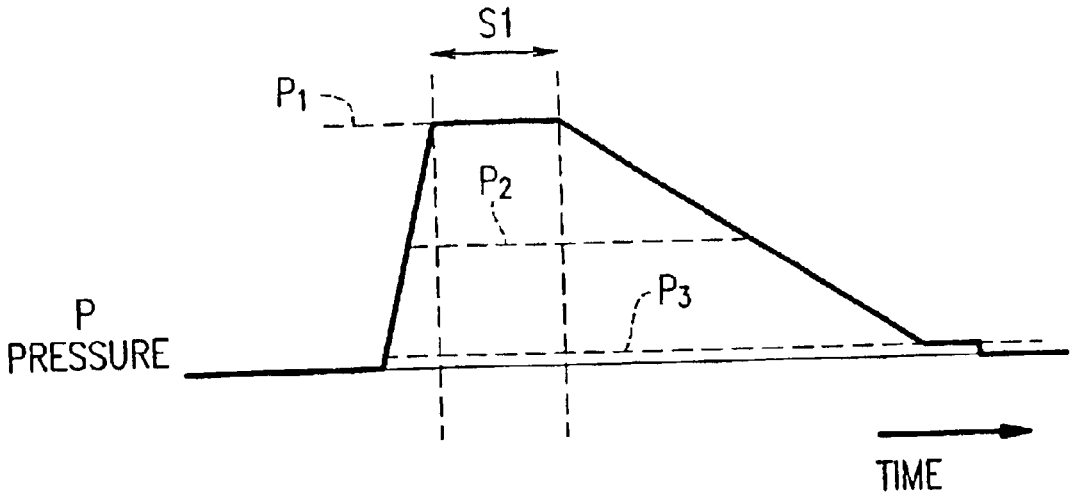
FIG. 8 is a graph showing a change of pressure P applied to a compact.

FIG. 8 is a graph showing the change of the compact pressure P. Referring to the graph, after the compact 30 has been produced under a predetermined compact pressure $P_1$ in a compression step S1, the upper punch 16 is lifted at a slow speed (or the applied pressure is reduced), to thereby gradually reduce the compact pressure P. The produced compact tends to expand toward a direction opposite to the pressing direction due to a so-called 'springback' phenomenon. The compact pressure P gradually decreases while the upper punch 16 and the compact are kept in contact with each other. This change of the compact pressure P is detected with the strain gages.

Once the decreasing compact pressure P reaches a predetermined value $P_2$, lowering of the die 10 is started, and along with this lowering, the compact 30 starts being exposed outside the cavity. Since the upper punch 16 continues to be lifted slowly, the compact pressure P further decreases.

As the lowering of the die 10 proceeds, a larger part of the compact is gradually exposed. The lifting of the upper punch 16 is halted before the compact is completely exposed outside the cavity, so that the compact pressure is maintained at a retaining pressure $P_3$. The retaining pressure $P_3$ can be set at a comparatively small value by use of the strain gages. The compact is then completely outside the cavity while the retaining pressure $P_3$ is kept applied. Thereafter, the upper punch 16 is lifted again while the compact 30 is left exposed on the die 10. In this way, the compact removal is completed.

By the above control of the upper punch 16 and the die 10 based on the compact pressure measured with the strain gages, it is possible to reduce cracking and collapsing of the compact during the removal of the compact from the cavity.

During the removal of the compact 30 from the cavity, stress may be applied to the compact 30 due to friction between the die 10 and the compact 30 and, as a result, a crack may be generated in the compact 30. If a predetermined pressure is kept applied to the compact 30 from the upper punch 16, generation of a crack is prevented. For this reason, a pressure is kept applied to the compact until the removal of the compact is completed.

If the above pressure applied to the compact is too large, the compact 30 removed from the cavity may collapse. In particular, the compact 30 is very susceptible to collapse in the state immediately before complete removal from the cavity. For this reason, the retaining pressure $P_3$ is set at a small value enough to avoid collapse.

By use of the strain gages as described above, the compact pressure can be detected precisely in real time. It is therefore possible to control the operations of the upper punch 16 and the die 10 so that cracking and collapsing of the compact are avoided, to ensure appropriate compact removal.

Using strain gages as described above, it is also possible to adjust the size of the compact, as well as the density of the compact. This adjustment will be described with reference to FIGS. 5, 9, and 10.

Figure 5:
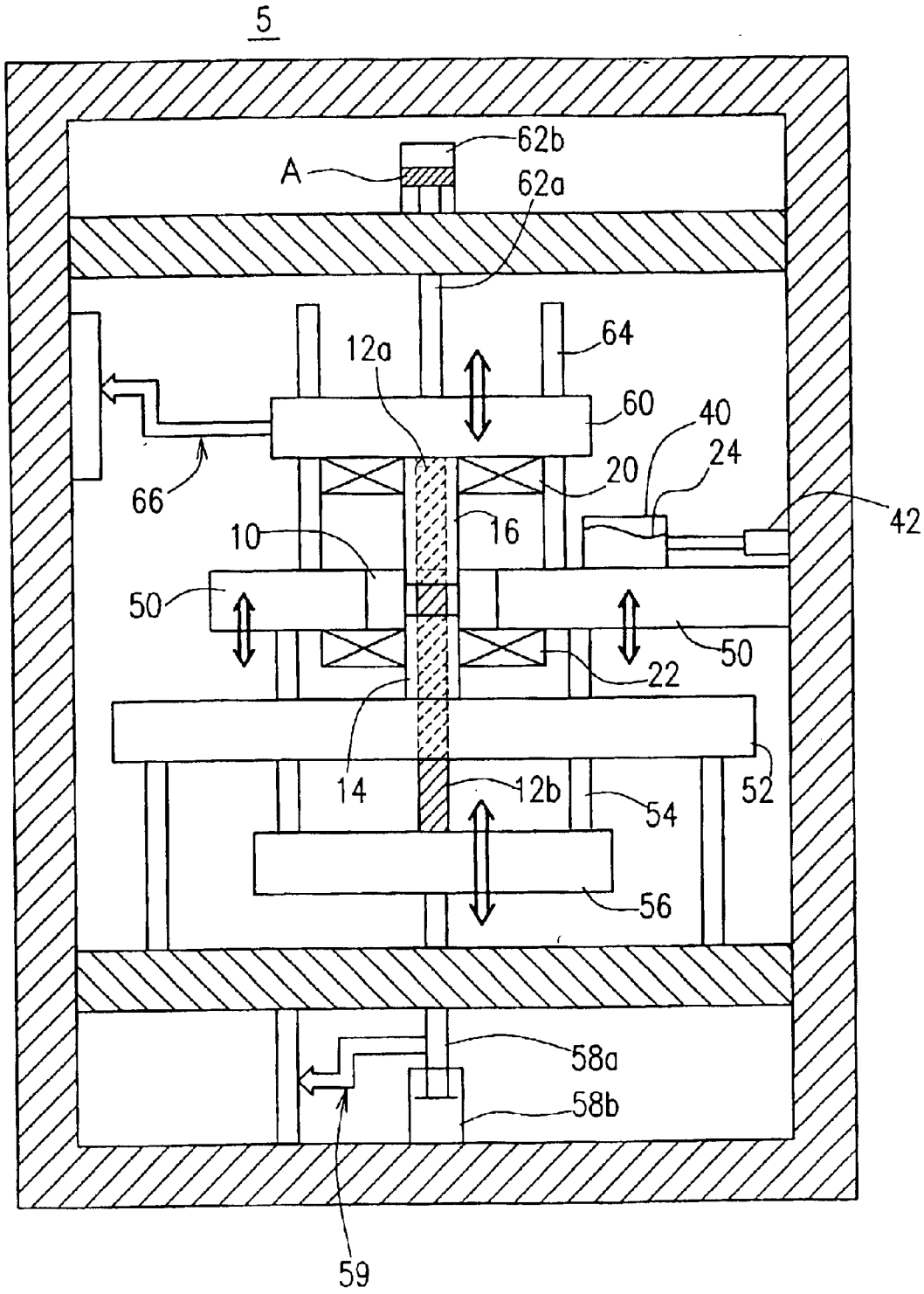
FIG. 5 is a side view of the entire construction of a powder compacting machine in an embodiment of the present invention.
Figure 9:
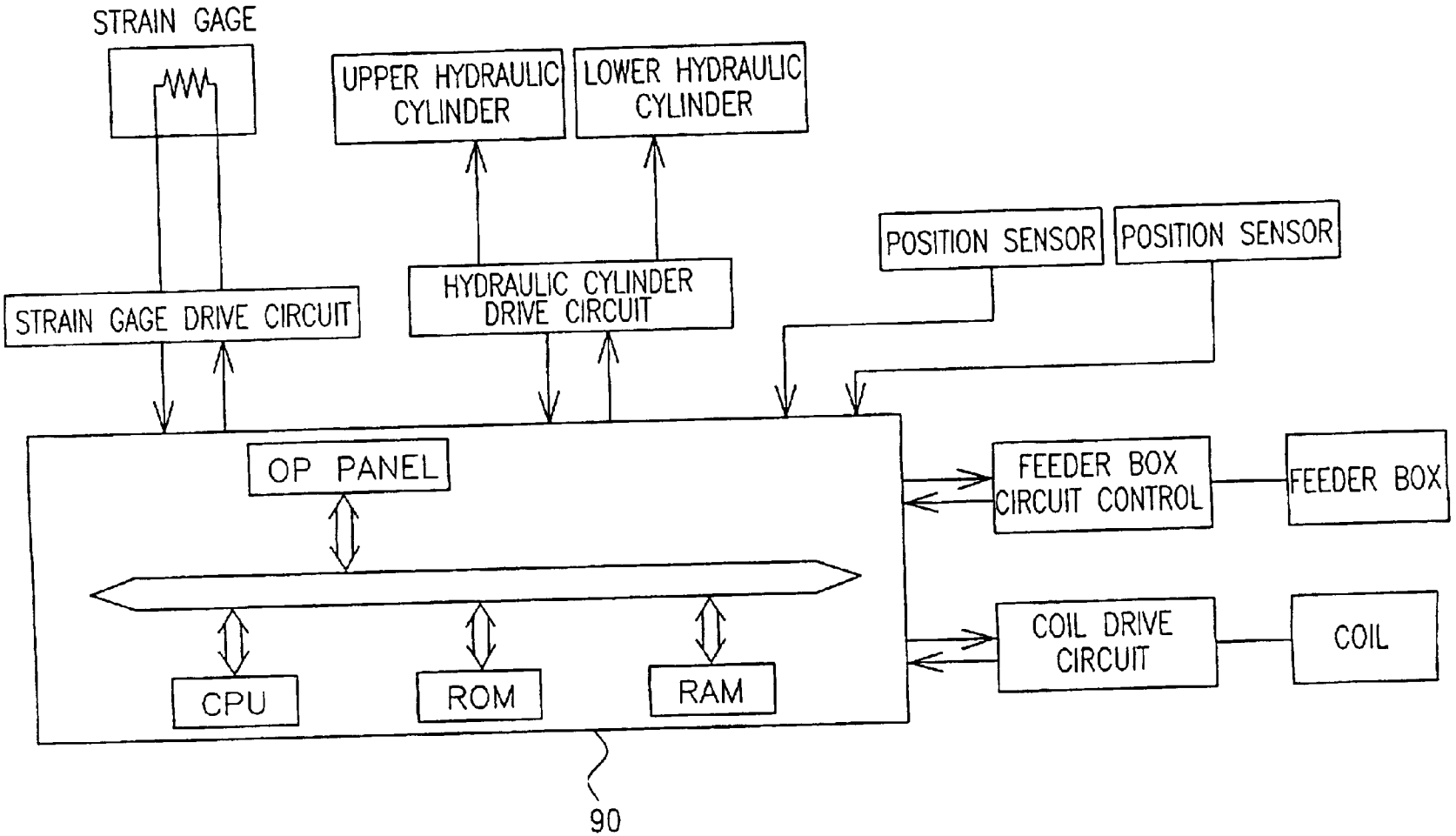
FIG. 9 is a block diagram of a control mechanism associated with the powder compacting machine shown in FIG. 5.

FIG. 9 is a block diagram of a control mechanism associated with the powder compacting machine shown in FIG. 5. A central control circuit 90 for controlling the operation of the powder compacting machine 5 includes: a CPU for executing operations; a RAM for storing information from strain gages, position sensors, and the like; and a ROM that stores control programs. An operation panel (OP PANEL) is connected to the central control circuit 90, so that an operator can input control information freely as required.

A strain gage drive circuit applies a predetermined voltage to a strain gage attached to the upper punch or the like and detects the magnitude of the strain (i.e., magnitude of the pressure applied to filled powder) based on the output from the strain gage. The magnitude of the strain is expressed as a change in the electric resistance of the strain gage. The strain gage drive circuit transmits the information on the pressure applied to the powder to the central control circuit 90 after converting the information to a digital signal by use of an A/D converter (not shown).

A hydraulic cylinder drive circuit drives the upper hydraulic cylinder 62*b* and the lower hydraulic cylinder 58*b* based on an instruction from the central control circuit 90. By the operation of the hydraulic cylinder drive circuit, the upper punch 16 and the die 10 can be moved to respective predetermined positions.

The position sensors 66 and 59 disposed in association with the upper punch 16 and the die 10, respectively, detect the positions of the upper punch 16 and the die 10, and transmit the position information to the central control circuit 90.

A feeder box drive circuit controls moving of the feeder box 40 toward and away from the position above the cavity. In the case where the feeder box 40 is provided with a powder-filling assist device such as a shaker (or agitator), the feeder box drive circuit also controls the operation of such an assist device. A coil drive circuit drives the coils 20 and 22 for generating magnetic fields for formation of a magnetic field applied to powder in the cavity. The central control circuit 90 controls these drive circuits.

Figure 10:
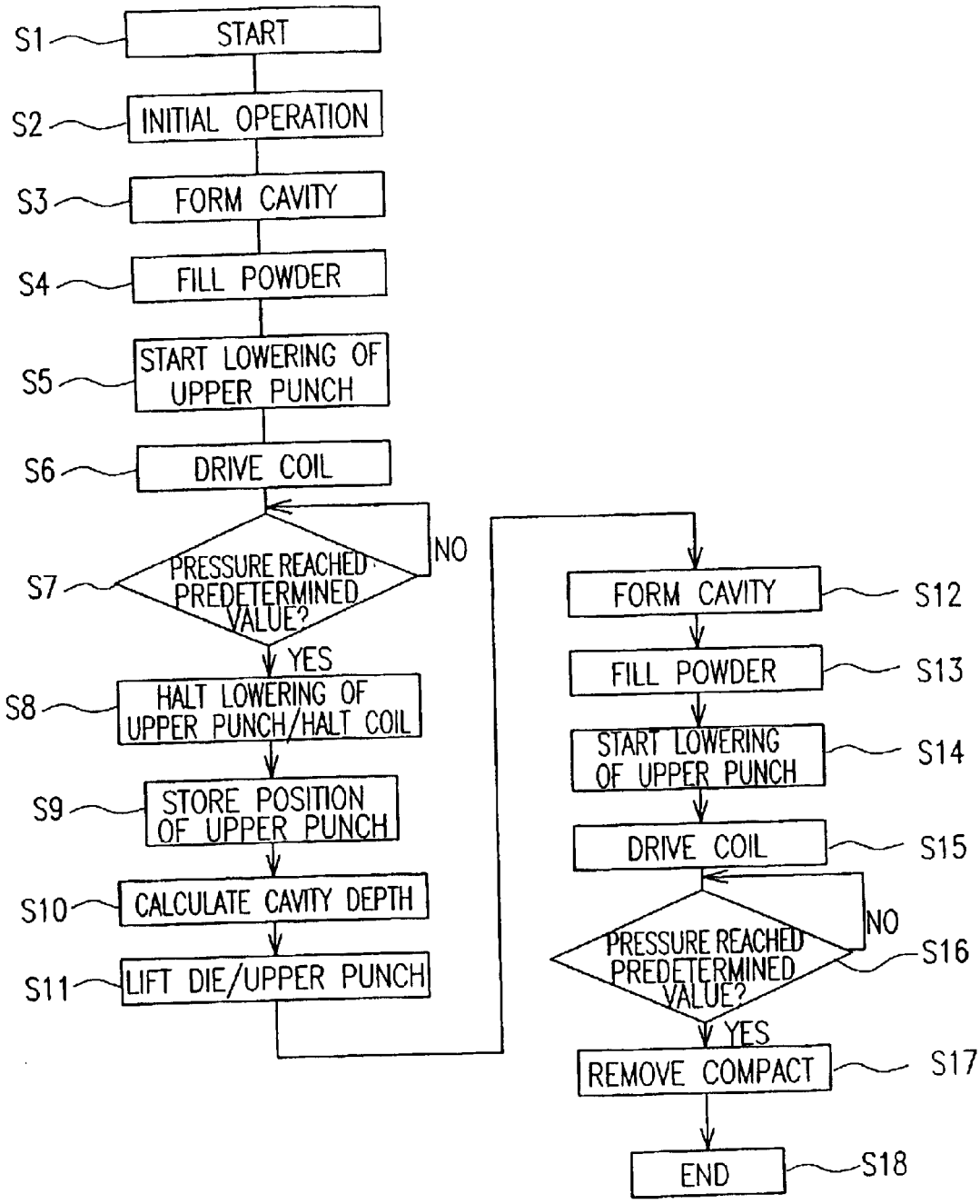
FIG. 10 is a flowchart showing a procedure of production of a compact using the control mechanism shown in FIG. 9.

Referring to FIG. 10, a compact production process using the above control mechanism will be described.

When a start button on the operation panel is depressed, the central control circuit 90 instructs the drive circuits to start respective initial operations. Upon receipt of READY signals from all the drive circuits, the central control circuit 90 starts pressing operation (steps S1 and S2). First, the die is lifted by driving the lower hydraulic cylinder, to form the first cavity (step S3). The central control circuit 90 instructs the feeder box drive circuit to fill the first cavity with powder (step S4). Upon receipt of notification from the feeder box drive circuit of completion of powder filling, the central control circuit 90 instructs the hydraulic cylinder drive circuit to drive the upper hydraulic cylinder so that the upper punch is lowered (step S5). Once the cavity is blocked with the upper punch, the coils for generating a magnetic field are driven so that the powder in the cavity is aligned (step S6).

In the above compression step, monitoring of the output of the strain gage drive circuit is started at the time when the upper punch starts compression of the powder, so that the pressure applied to the powder in the cavity is measured. The magnitude of the pressure applied to the powder increases as the upper punch is lowered. When it is detected that the pressure applied to the powder has reached a predetermined value (step S7), the lowering of the upper punch is halted, and simultaneously, the application of the magnetic field is halted (step S8).

The position of the upper punch in the above compressing state is detected with the position sensor. The position information from the position sensor is stored in the RAM of the central control circuit 90 (step S9).

When the compression is performed based on the pressure applied to the powder as described above, if the amount of powder filled in the cavity is different, the position of the upper punch in the compressing state is different. This may results in variation in the size (height) of the compact produced in the first-stage compression step. To overcome this problem, in this embodiment, the depth of a cavity (second cavity) to be formed in the second-stage compression step is calculated based on the position of the upper punch. More specifically, the depth of a cavity to be formed at the next stage is determined by subtracting the height of the first-stage compact determined from the position of the upper punch from the whole height of a compact to be formed in the next (second) stage compression step. By this procedure, a compact with high size precision can be produced even when the filled powder amount varies. If the length of the first-stage compact is out of desired range, the first-stage compact can be removed from the cavity and a new first-stage compact can be made before second-stage compacting step is performed.

Once the depth of the cavity at the next stage is determined, the die and the core are lifted to a predetermined position based on the calculated cavity depth while the compact is kept sandwiched by the upper and lower punches. The upper punch is then lifted, thereby forming the second cavity (steps S11 and S12).

Thereafter, as in the first-stage compression step, powder filling (step S13) and compression (steps S14 through S16) are performed, to produce the compact. During the second pressing operation, also, a predetermined pressure is applied to the powder with the aid of the strain gage. In this way, a compact with uniform density and high size precision can be produced.

The compact produced by the multi-stage compacting method as described above is removed from the cavity in the manner described above with reference to FIG. 8, for example, that can prevent the compact from breaking (step S17). Thus, the compact production process is completed (step S18).

Figure 3:
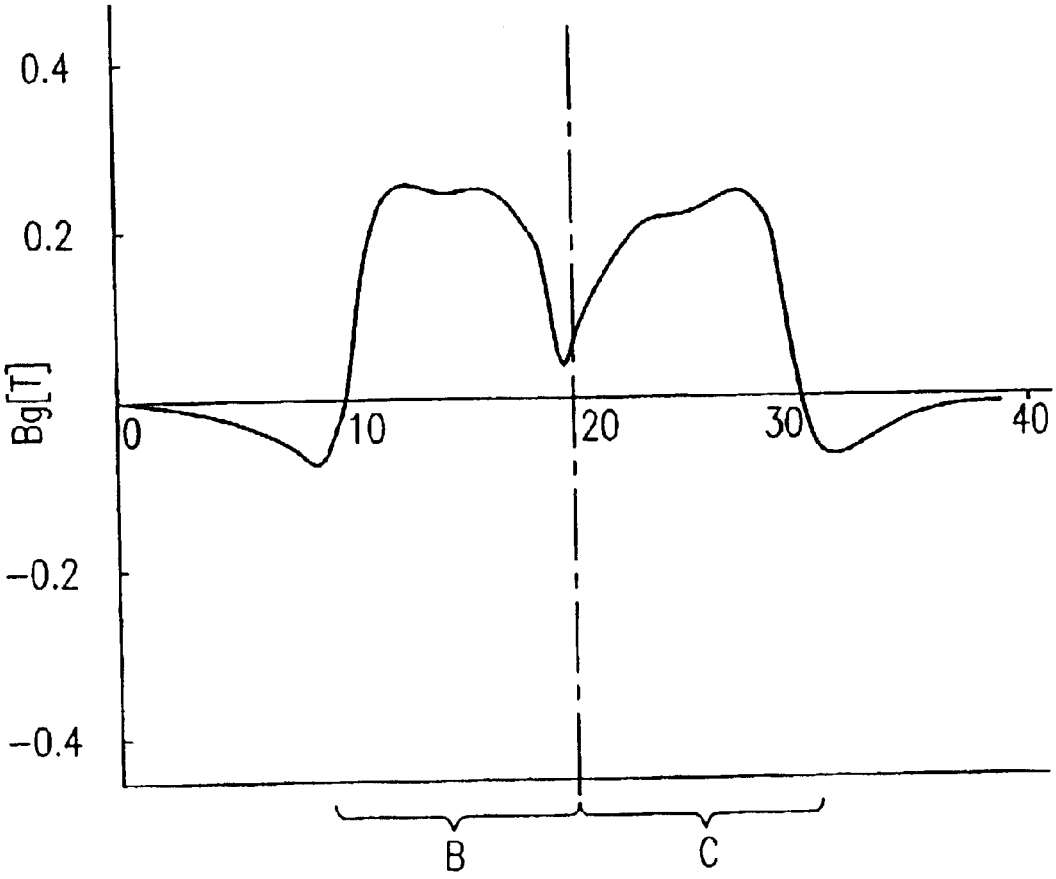
FIG. 3 is a graph showing the surface magnetic flux density (Bg) at the outer circumference of a cylindrical magnet manufactured by a conventional multi-stage compacting method.
Figure 4:
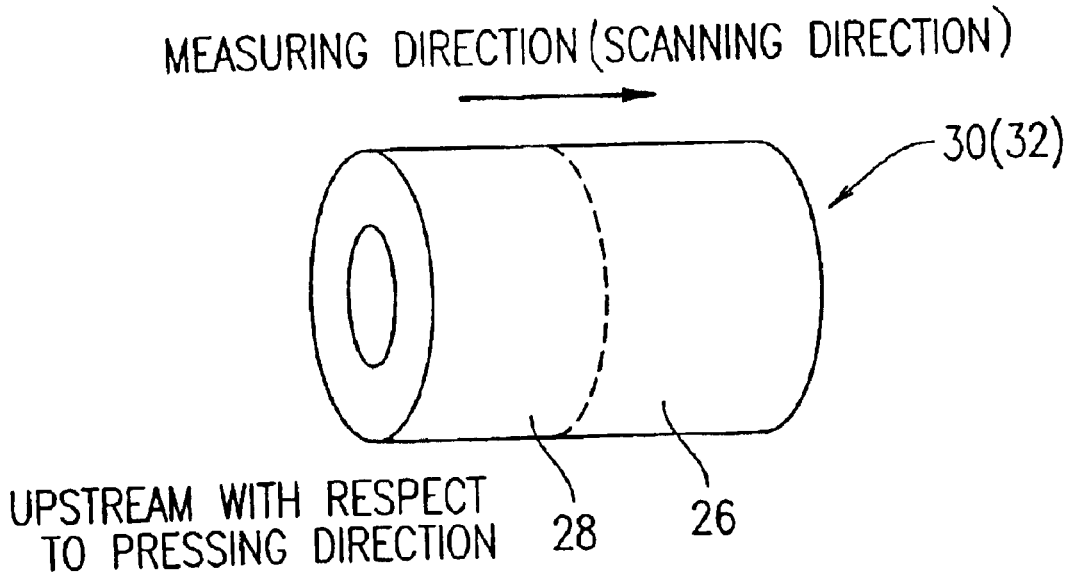
FIG. 4 is a perspective view of the cylindrical magnet measured for obtaining the graph in FIG. 3.
Figure 11:
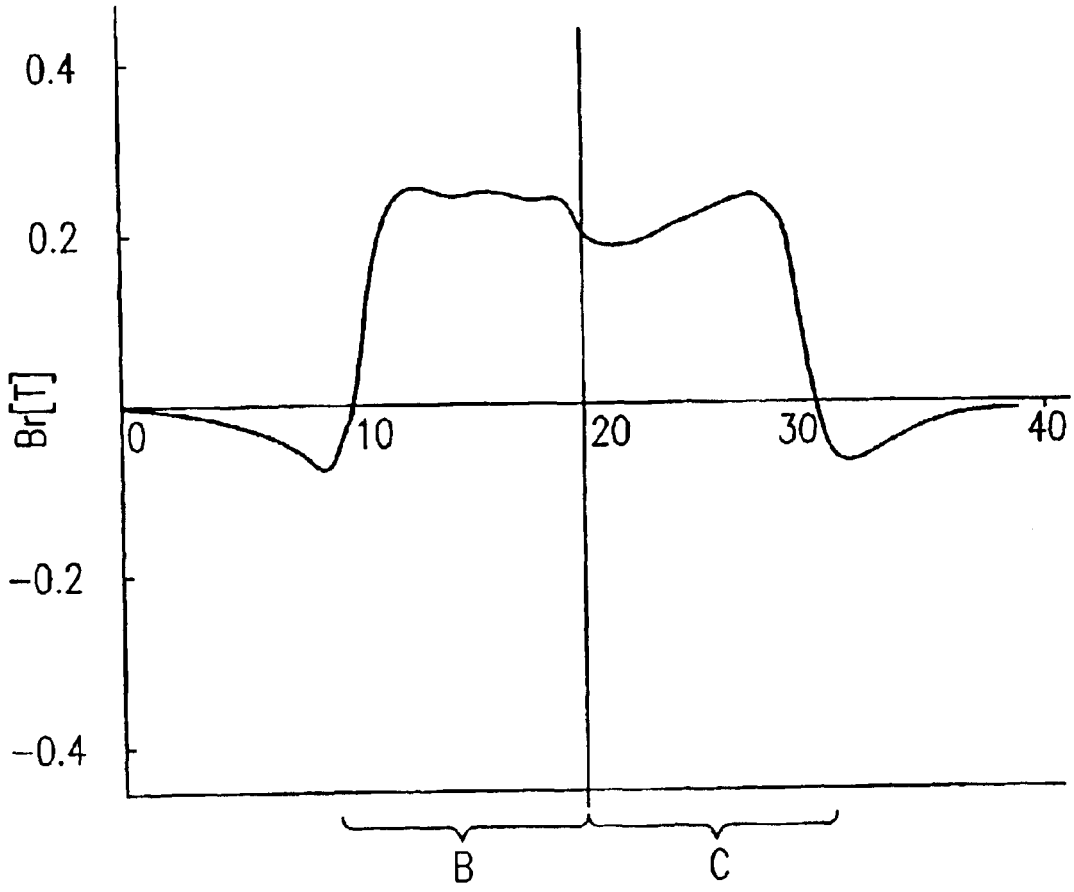
FIG. 11 is a graph showing the surface magnetic flux density (Bg) at the outer circumference of a magnet in an embodiment of the present invention.

FIG. 11 is a graph showing the surface magnetic flux density (Bg) of a magnet in the embodiment of the present invention, made up to correspond to the graph shown in FIG. 3. For the evaluation, the compact was sintered and surface-finished to manufacture a ring magnet having an outer diameter of 16.4 mm, an inner diameter of 10.5 mm, and an axial length of 20 mm. To facilitate the evaluation, the magnetization was performed using a magnetic field vertical to the axial direction of the magnet.

As is apparent from the graph in FIG. 11, the drop in surface magnetic flux density (Bg) observed at the boundary of the first-stage and second-stage compacts 26 and 28 is noticeably small compared with that in the conventional case shown in FIG. 3. Actually, in the case in FIG. 11, the surface magnetic flux density (Bg) at the boundary is about 70% or more of the maximum value of the surface magnetic flux density (Bg) at the other portion. According to the present invention, the surface magnetic flux density (Bg) at the boundary can be at least about 65% of the maximum value of the surface magnetic flux density (Bg) at the other portion. It can be about 75% or more, or even about 80% or more.

If a magnet having high magnetic properties as a whole is used for a motor, the energy efficiency of the motor improves. Therefore, the magnet manufactured in this embodiment is especially suitable for a motor for a robot that realizes factory automation (FA).

The reason why the reduction in the surface magnetic flux density (Bg) at the boundary of multi-stage compacting can be suppressed in the embodiment of the present invention is as follows. The relative position of the first-stage compact 26 is high compared with the conventional case, and thus at least part of the first-stage compact 26 is placed inside the orienting space. Therefore, when the second-stage compression step is performed, the axial components of the aligning magnetic field generated due to the existence of the first-stage compact 26 reduces, thereby greatly improving the degree of alignment. Since part of the already-aligned compact is placed inside the orienting space as described above, the size of a compact to be produced at the next stage is reduced. In the context of the conventional method, it will be an inefficient practice to place the first-stage compact 26 inside the space between the magnetic portion 10*a* of the die 10 and the core 12, that is, the orienting space. The present invention adopted this inefficient practice on purpose, and thereby succeeded in noticeably suppressing the reduction in degree of alignment in the multi-stage compacting.

As the magnetic powder, preferably powder produced by a strip casting method is used. A procedure of producing magnetic powder by the strip casting method is as follows, for example.

First, an alloy of 31Nd—1B—68Fe (mass %) as disclosed in U.S. Pat. No. 5,383,978 is melted by a high frequency melting method in an argon gas atmosphere to produce alloy molten mass. An alloy containing Co substituted for part of Fe may also be used. Alternatively, an alloy having a composition disclosed in U.S. Pat. No. 4,770,723 may be used.

The alloy molten mass, the temperature of which is kept at 1350° C., is put in contact with the surface of a rotating single roll, to thereby quench the molten mass. Thus, a quenched and solidified alloy having a desired composition is obtained. If the cooling conditions are such that the roll peripheral velocity is about 1 m/sec, the cooling rate is 500° C./sec, and the degree of supercooling is 200'0 C., a flake alloy having a mean thickness of 0.3 mm is obtained.

The thus-obtained alloy is enbrittled by hydrogen absorption, and roughly ground to a size of about 5 mm with a feather mill. The roughly ground alloy is then finely pulverized to powders of a mean grain size of 3.5 $\mu$m. Thereafter, fatty ester diluted with a petroleum-based solvent as a lubricant is added to and mixed with the powders. The added amount of the lubricant may be 0.3 mass % with respect to the alloy powder, for example. As the lubricant, a solid lubricant such as zinc stearate may also be used.

The rare earth alloy powder produced by the strip casting method and the pulverizing process described above exhibits a sharp granular variation (particle distribution) compared with powder produced by another method (ingot method). Therefore, when a compact is produced from such rare earth powder and sintered, a sintered body with uniform grain size is obtained. Such a sintered body provides excellent magnetic properties. The powder produced by the strip casting method however has the following problem. Due to the sharp granular variation, flowability of the powder is poor and thus the powder fails to be filled uniformly. This problem can be solved by controlling the pressure applied to the compact with the aid of the pressure sensor as described above. By this control, the compacting density can be made uniform, and the resultant compact has a density exceeding a predetermined level and a high degree of alignment.

The rare earth alloy suitably used for the method for compacting powder of the present invention is generally represented as R-T-(M)-B alloy powder (where R denotes a rare earth element including Y, T denotes Fe or a mixture of Fe and Co, M denotes an additive element, and B denotes boron). As the rare earth element R, a material containing at least one kind of element selected from Y, La, Ce, Pr, Nd, Sm, Gd, Th, Dy, Ho, Er, Tm, and Lu can be used. In order to obtain sufficient magnetization, either one or both of Pr and Nd should preferably occupy 50 at % or more of the rare earth element R.

If the content of the rare earth element R is 10 at % or less, the coercive force is lowered due to precipitation of an $\alpha$-Fe phase. If the content of the rare earth element R exceeds 20 at %, a R-rich second phase is excessively precipitated in addition to a target tetragonal $Nd_2Fe_{14}B$ type compound, resulting in lowering the magnetization. For these reasons, the content of the rare earth element R is preferably in the range of 10 to 20 at %.

If the content of T, which represents Fe, Co, and the like, is less than 67 at %, a second phase that is poor both in coercive force and magnetization is precipitated, resulting in degrading the magnetic properties. If the content of T exceeds 85 at %, the coercive force is lowered due to precipitation of an $\alpha$-Fe phase. In addition, the angularity of the demagnetization curve is degraded. For these reasons, the content of T is preferably in the range of 67 to 85 at %.

Although T may be composed of only Fe, the addition of Co raises the Curie temperature and thus improves heat resistance. Preferably, Fe occupies 50 at % or more of T. If the occupation of Fe is less than 50 at %, the saturation magnetization of a $Nd_2Fe_{14}B$ type compound itself decreases.

Boron (B) is indispensable for stable precipitation of a tetragonal $Nd_2Fe_{14}B$ type crystal structure. If the content of B is less than 4 at %, the coercive force is lowered since a $R_2T_{17}$ phase is precipitated, resulting in significant degradation in the angularity of the demagnetization curve. If the content of B exceeds 10 at %, a second phase that is poor in magnetization is precipitated. For these reasons, the content of B is preferably in the range of 4 to 10 at %. Alternatively, part or the entire of B may be replaced with C.

The additive element M may be provided for improving the magnetic natures and corrosion resistance of the powder. As the additive element, suitably used is at least one kind of elements selected from the group consisting of Al, Ti, Cu, V, Cr, Ni, Ga, Zr, Nb, Mo, In, Sn, Hf, Ta, and W. Such an additive element M may not be provided at all. If provided, the addition amount is preferably 10 at % or less. If the addition amount exceeds 10 at %, a non-ferromagnetic second phase is precipitated, lowering the magnetization.

As the material for the magnetic portion of the die and the core, selected preferably is a material that is high in magnetic permeability and saturation flux density and excellent in abrasion resistance. Examples of such a material include carbon tool steel (SK), alloy tool steel (SKS, SKD), high-speed tool steel (SKH), and Permendur. If priority is put on abrasion resistance, a substrate having a high magnetic permeability and a high saturation flux density, such as that made of Permendur, permalloy, and sendust, may be coated with a coating layer made of hard metal.

The present invention is broadly applicable to production of bonded magnets, not only to the production of sintered magnets. In the application of the present invention to production of bonded magnets, magnetic powder coated with a binder is filled in the cavity of the compacting machine. As the binder, a thermosetting resin such as an epoxy resin and a phenol resin can be used. After compacting, curing at about 120° C. is required to complete the bonded magnet.

The present invention is also applicable to production of non-cylindrical magnets. For example, the present invention can be applied to manufacture of an arc-shaped magnet, as that disclosed in Japanese Laid-Open Publication No. 4-352402, by the multi-stage filling method.

The powder compacting machine used in the present invention is not limited to that described in the above embodiment. It should be noted that the lifting/lowering operations of the upper and lower punches and the die described above merely represent relative movements to each other and can be modified in various ways.

In the case of manufacturing one magnet from three or more compacts by multi-stage compacting, it is not necessary to arrange so that the top surface of a compact produced in the immediately preceding compression step is located above the position of the bottom surface of the magnetic portion of the die in all the second and subsequent compression steps. In manufacture of a long cylindrical magnet by multi-stage compacting, a high degree of alignment may be necessary only for a portion of the magnet actually requiring a high degree of alignment in some cases depending on the application. If the portion requiring a high degree of alignment includes a compact boundary, the present invention may be applied so as to improve the degree of alignment at least in this boundary portion.

According to the present invention, a high degree of radial alignment is attained even in the multi-stage filling and compacting process. This makes it possible to provide a high-performance radially oriented anisotropic magnet. In the case of using rare earth alloy powder excellent in magnetic properties, the degree of alignment tends to decrease since an intense magnetic field is often applied while the compacting density is kept low. According to the present invention, however, such decrease of the degree of alignment can be suppressed.

While the above exemplary embodiment of the invention uses the dry compacting process, the present invention can be applied to the wet compaction process in which slurry comprising powder and oil is compressed in the cavity.

While the present invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention which fall within the true spirit and scope of the invention.

What is claimed is:

1. A method for producing a compact of rare earth alloy powder comprising:

a first step of filling the rare earth alloy powder in a cavity of a compacting machine, said machine comprising a lower punch and an upper punch, a second step of pressing the rare earth alloy powder while applying a magnetic field to the rare earth alloy powder and detecting a pressure applied to the rare earth alloy powder in the cavity by a pressure sensor; and a step of repeating the first step and the second step to produce the compact of the rare earth alloy powder;

wherein the relative position of the upper punch and the lower punch is controlled according to the pressure detected by the pressure sensor.

2. A method according to claim 1, wherein the compacting machine further comprises a die including a nonmagnetic portion and a magnetic portion placed on the nonmagnetic portion, the die having a through hole; and a magnetic core having an outer circumference facing an inner wall of the through hole, wherein the lower punch is inserted from below into a space formed between the inner wall of the through hole and the outer circumference of the magnetic core, and the upper punch is inserted from above into the space formed between the inner wall of the through hole and the outer circumference of the magnetic core, wherein when an (n+1)th stage second step is to be carried out, where n is an integer equal to or greater than 1, a top surface of a compact produced in an n-th stage second step is placed at a position above a bottom surface of the magnetic portion of the die.

3. A method according to claim 2, wherein in the (n+1)th stage second step, the level difference between the top surface of the compact produced in the n-th stage compression step and the bottom surface of the magnetic portion of the die is 3 mm or more.

4. A method according to claim 1, wherein the density of the compact produced in the second step is adjusted by controlling the pressure applied to the rare earth alloy powder.

5. A method according to claim 1, wherein the intensity of the magnetic field in the cavity is 0.4 MA/m or more.

6. A method according to claim 1, wherein a lubricant is added to the rare earth alloy powder.

7. A method according to claim 1, wherein the amount of the rare earth alloy powder filled in the cavity is larger in an n-th stage first step than in an (n+1)th stage first step, where n is an integer equal to or greater than 1.

8. A method according to claim 1, wherein the rare earth alloy powder is made of a R-T-(M)-B alloy, where R denotes a rare earth element containing at least one of the element selected from the group consisting of Y, La, Ce, Pr, Nd, Sm, Gd, Tb, Dy, Ho, Er, Tm, and Lu; T denotes Fe or a mixture of Fe and Co; M denotes an additive element; and B denotes boron.

9. A method according to claim 1, wherein the compact is formed in a cylindrical shape, and the magnetic field is a radial magnetic field.

10. A method according to claim 1, wherein the density of the compact produced in an n-th stage compression step is 3.5 g/cm$^3$ or more.

11. A method according to claim 1, wherein the rare earth alloy powder is filled in the cavity from a feeder box storing the rare earth alloy powder therein.

12. A method according to claim 1, wherein the rare earth alloy powder is produced by a strip casting method.

13. A method for manufacturing a rare earth magnet comprising sintering a compact produced by the method for producing a compact of rare earth alloy powder according to claim 1, to obtain a permanent magnet.

14. A method for producing a compact of rare earth alloy powder comprising:

forming a first cavity defined by a die and a lower punch;

filling rare earth alloy powder in the first cavity;

compressing the powder filled in the first cavity until a pressure applied to the powder in the first cavity reaches a first predetermined value;

forming a second cavity on the compressed powder by relative movement of the die and the lower punch after compressing the powder filled in the first cavity;

filling rare earth alloy powder in the second cavity; and compressing the powder filled in the second cavity until a pressure applied to the powder in the second cavity reaches a second predetermined value.

15. A method according to claim 14, further comprising a step of storing the position of a top surface of the compact produced in the first cavity, wherein the second cavity is formed by the relative movement of the die and the lower punch based on the position of the top surface of the compact.

16. A method according to claim 14, wherein the first cavity and the second cavity are of a cylindrical shape.

* * * * *